US009550595B2

(12) United States Patent
Steidele

(10) Patent No.: US 9,550,595 B2
(45) Date of Patent: Jan. 24, 2017

(54) METHOD FOR OPERATING A CHAMBER PACKAGING MACHINE

(71) Applicant: Multivac Sepp Haggenmüller GmbH & Co. KG, Wolfertschwenden (DE)

(72) Inventor: Jürgen Steidele, Hawangen (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 596 days.

(21) Appl. No.: 14/021,444

(22) Filed: Sep. 9, 2013

(65) Prior Publication Data

US 2014/0069057 A1 Mar. 13, 2014

(30) Foreign Application Priority Data

Sep. 10, 2012 (DE) ..... 10 2012 017 827

(51) Int. Cl.
*B65B 31/02* (2006.01)
*B65B 57/00* (2006.01)

(52) U.S. Cl.
CPC ..... *B65B 31/024* (2013.01); *B65B 57/00* (2013.01); *B65B 31/02* (2013.01); *B65B 31/028* (2013.01)

(58) Field of Classification Search
CPC ..... B65B 31/025; B65B 57/00; B65B 31/028; B65B 31/02; B65B 31/024
See application file for complete search history.

(56) References Cited

U.S. PATENT DOCUMENTS 3,699,742 A * 10/1972 Giraudi ..... B65B 31/024 53/374.8
3,714,754 A * 2/1973 Holcombe et al. ..... B65B 31/06 53/138.4
3,928,938 A * 12/1975 Burrell ..... B65B 31/024 53/417
3,958,391 A * 5/1976 Kujubu ..... B65B 31/022 53/434
3,965,646 A * 6/1976 Hawkins ..... B65B 31/024 53/512
4,164,111 A * 8/1979 Di Bernardo ..... B65B 31/024 53/434
4,471,599 A * 9/1984 Mugnai ..... B65B 53/06 53/434
4,640,081 A * 2/1987 Kawaguchi ..... B65B 9/067 198/463.3
4,922,686 A * 5/1990 Segota ..... B65B 31/024 53/434
4,926,614 A * 5/1990 Costello ..... B65B 31/06 53/434
5,027,578 A * 7/1991 Natterer ..... B65B 31/02 53/390

(Continued)

FOREIGN PATENT DOCUMENTS

AU WO 8901440 A1 * 2/1989 ..... B65B 31/024
DE 1586146 A1 * 8/1970 ..... B65B 31/024

(Continued)

*Primary Examiner* — Hemant M Desai
*Assistant Examiner* — Lucas Palmer
(74) *Attorney, Agent, or Firm* — Husch Blackwell LLP

(57) ABSTRACT

The invention relates to a method for operating a chamber packaging machine, wherein the position of a sealing bar is during the evacuation of a diaphragm checked using a sensor.

5 Claims, 4 Drawing Sheets

(56) References Cited

U.S. PATENT DOCUMENTS 5,044,142 A * 9/1991 Gianelli ..... B65B 31/024 53/434
5,056,292 A * 10/1991 Natterer ..... B29C 65/18 53/373.4
5,239,808 A * 8/1993 Wells ..... B29C 65/228 53/373.7
5,678,387 A * 10/1997 Aarts ..... B65B 31/024 53/434
5,682,727 A * 11/1997 Harte ..... B65B 31/024 53/434
2002/0043050 A1* 4/2002 Costello ..... B65B 31/024 53/434
2003/0046907 A1* 3/2003 Costello ..... B65B 31/024 53/512
2003/0159405 A1* 8/2003 Knowlton ..... B29C 65/743 53/434
2004/0060262 A1* 4/2004 Harges ..... B29C 65/18 53/434
2004/0144063 A1* 7/2004 Countz ..... B65B 31/024 53/434
2004/0213879 A1* 10/2004 Jang ..... B65B 31/02 426/404
2010/0293899 A1* 11/2010 Boekstegers ..... B65B 31/021 53/507
2011/0258967 A1* 10/2011 Dietrich, Jr. ..... B65B 31/024 53/432
2011/0289885 A1* 12/2011 Re ..... B29C 65/224 53/432
2012/0110956 A1* 5/2012 Miller ..... B29C 65/18 53/440
2012/0111449 A1* 5/2012 Hsu ..... B65B 1/10 141/82
2012/0174531 A1* 7/2012 Rothermel ..... B65B 31/024 53/432
2014/0165502 A1* 6/2014 Wah ..... B65B 51/10 53/329.2
2015/0040517 A1* 2/2015 Furuse ..... B65B 51/146 53/405

FOREIGN PATENT DOCUMENTS

DE 3916190 A1 11/1990
DE 102010026618 A1 * 1/2012 ..... B29C 65/18
EP 0004239 A3 * 10/1979 ..... B29C 66/843
EP 1564147 A1 * 8/2005 ..... B65B 31/024
FR 2568544 A1 * 2/1986 ..... B65B 31/024
IT WO 2011058589 A1 * 5/2011 ..... B65B 31/024
NZ WO 9003920 A1 * 4/1990 ..... B65B 31/024
NZ CA 2474204 A1 * 9/2003 ..... B65B 31/024
NZ CA 2510804 A1 * 7/2004 ..... B65B 31/024

* cited by examiner

METHOD FOR OPERATING A CHAMBER PACKAGING MACHINE

CROSS-REFERENCE TO RELATED APPLICATIONS

This Application claims priority to German Application Number 102012017827.1 filed Sep. 10, 2012, to Jürgen Steidele entitled "Method for operating a chamber packaging machine," currently pending, the entire disclosure of which is incorporated herein by reference.

FIELD OF THE INVENTION

The invention relates to a method for operating a chamber packaging machine or a conveyor belt packaging machine.

BACKGROUND OF THE INVENTION

The applicant's conveyor belt packaging machines are known from practice in which a sealing device comprises a sealing bar and a diaphragm. To seal a bag, the diaphragm is subjected to pressure to press the sealing bar against a counter-pressure bar in order to heat-seal the bag neck clamped between the sealing bar and the counter-pressure bar. During the evacuation of the bag, the sealing bar is moved to an evacuation position in which the gap between the sealing bar and a counter-pressure bar is at a maximum. This is accomplished by evacuating the diaphragm, and by a device pressing the sealing bar against the diaphragm with springs. The diaphragm is connected to a vacuum pump, which is also connected to the vacuum chamber for evacuating the bag, via a supply line that is partially provided also outside of the vacuum chamber. If the supply line is leaking in a section between the vacuum chamber and the vacuum pump, then this leakage can cause the sealing bar not to reach its evacuation position and the gap between the sealing bar and the counter-pressure bar, and thereby the opening of the bag neck is reduced such that evacuation or minimizing the oxygen content is not sufficient to meet the specified minimum shelf life, especially for foods to be packaged, such as meat, so that returns and complaints can occur. Such leakage of the diaphragm or in the supply line can also lead to the intended sealing pressure not being reached, and thereby the quality of the sealing seam being reduced, without this being easily apparent to the user during a visual check.

SUMMARY OF THE INVENTION

The object of the present invention is to increase process reliability of a chamber packaging machine or a conveyor belt packaging machine.

A method according to one embodiment of the present invention for operating a chamber machine or conveyor belt machine comprising a control unit, a sealing bar, a diaphragm and a sensor, comprises the steps of:

- forming a vacuum chamber by closing a cover,
- evacuating the vacuum chamber,
- evacuating the diaphragm and checking with the sensor whether the sealing bar is in its predetermined evacuation position,
- applying compressed air to the diaphragm after evacuation to generate sealing pressure between the sealing bar and a counter-pressure bar in order to seal the product in a bag in an airtight manner.

This method offers the advantage that any defects or leaks in the diaphragm, the supply lines inside and outside of the vacuum chamber or a compressed air source are detected by the control unit and are communicated to the user by an error message via a display. Also, broken springs can be detected that press the sealing bar against the diaphragm, or any blockade of the sealing bar.

The sealing pressure may be checked with a pressure measurement unit in a supply line to the diaphragm. The pressure measuring unit can be connected to the control unit to automatically perform this check.

In one embodiment, the control unit transmits information to the operator via a display when checking the position of the sealing bar using the sensor during evacuation of the diaphragm or checking the sealing pressure during the sealing procedure is negative, i.e., a value outside a predetermined range is obtained. It can thereby be prevented that a defective seal, barely recognizable by the operator, leaves the production and, where the product is food, such as meat, the shelf life is not ensured which results in complaints.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are throughout the figures designated with the same reference numerals.

DETAILED DESCRIPTION OF THE INVENTION

Figure 1:
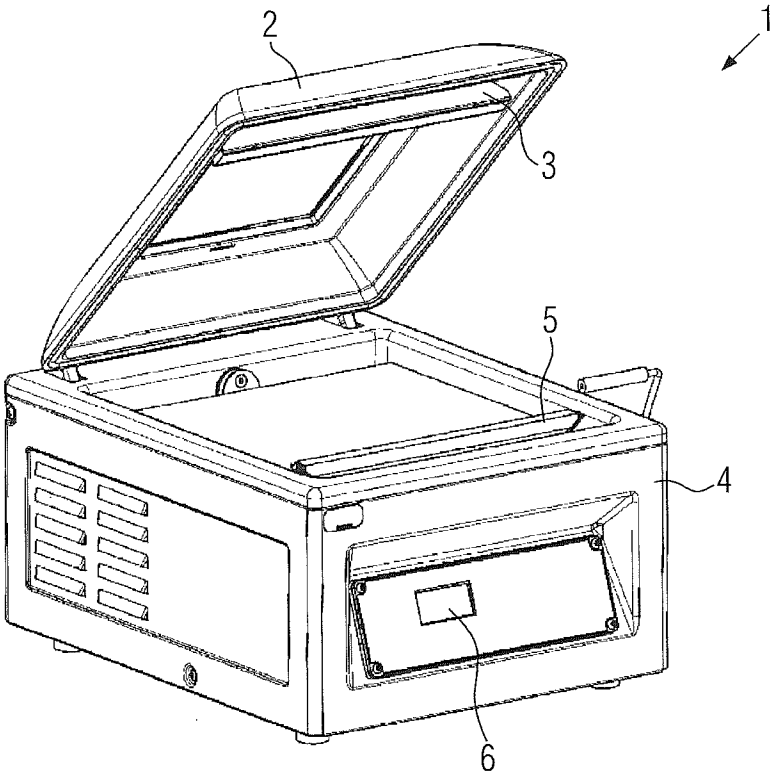
FIG. 1 is a schematic perspective view of a chamber machine in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a chamber machine 1 according to one embodiment of the present invention with a cover 2 comprising a sealing bar 3, and a housing 4 comprising a counter-pressure bar 5 and a display 6.

Figure 2:
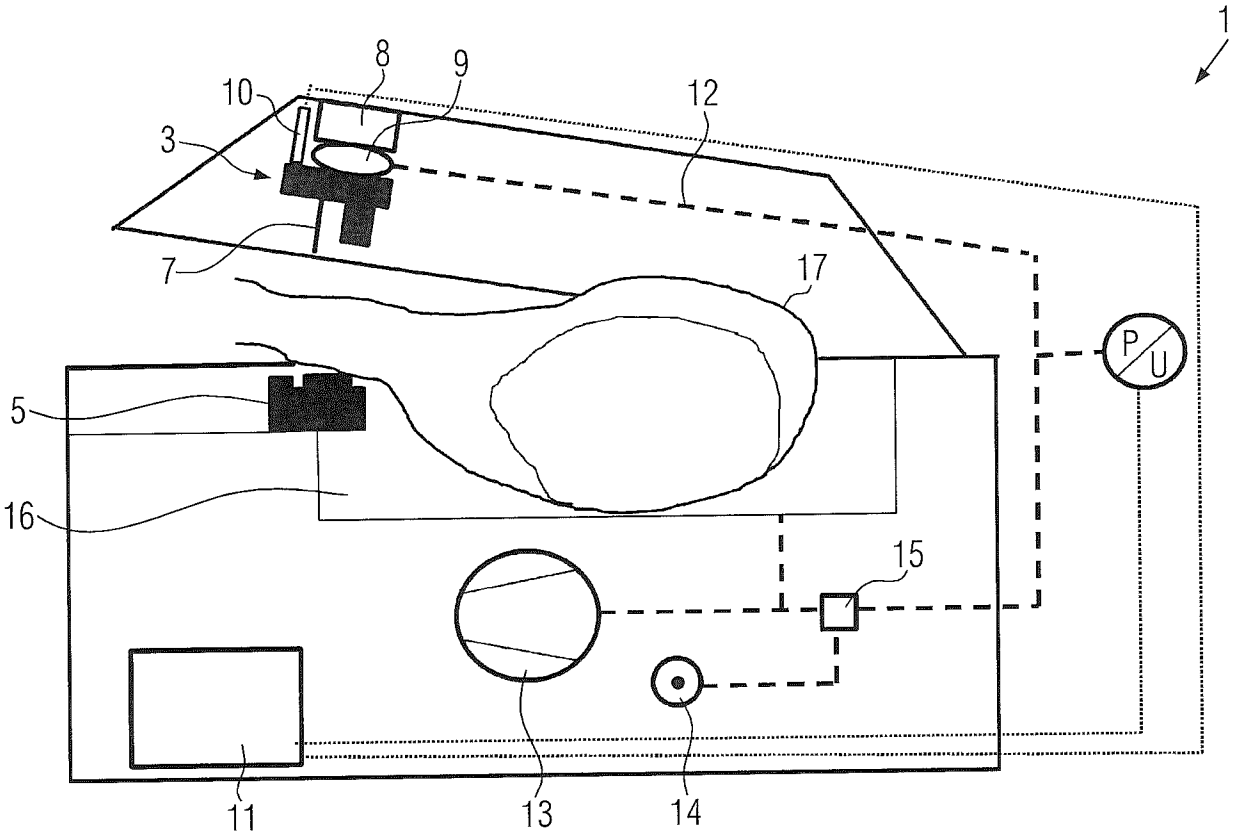
FIG. 2 is a side sectional view of a chamber machine in an open position in accordance with one embodiment of the present invention.

In a side sectional view of the chamber machine 1, FIG. 2 shows the set-up of the sealing bar 3 in the cover 2. The sealing bar 3 may comprise a blade bar 7 for severing a bag neck 19 (see FIG. 4) of a bag 17. With springs—not shown—the sealing bar 3 can be connected to a support 8 to be supported at the cover 2. A diaphragm 9 can be provided between the sealing bar 3 and the support 8, which can move the sealing bar 3 relative to the cover 2. A sensor 10, specifically, a position sensor, such as a non-contact inductive or capacitive proximity switch or a light barrier, can examine whether the sealing bar 3 reaches an evacuation position (see FIG. 3). The sensor 10 can be connected to a control unit 11. The diaphragm 9 can be, via a supply line 12, connected to a vacuum pump 13 and optionally to a compressed air source 14 and is switchable using a 3-way valve 15 between the vacuum pump 13 and the compressed air source 14. The sealing bar 3 can be held in the evacuation position, which is checked by the sensor 10, both by springs as well as by the vacuum pump 13.

Figure 3:
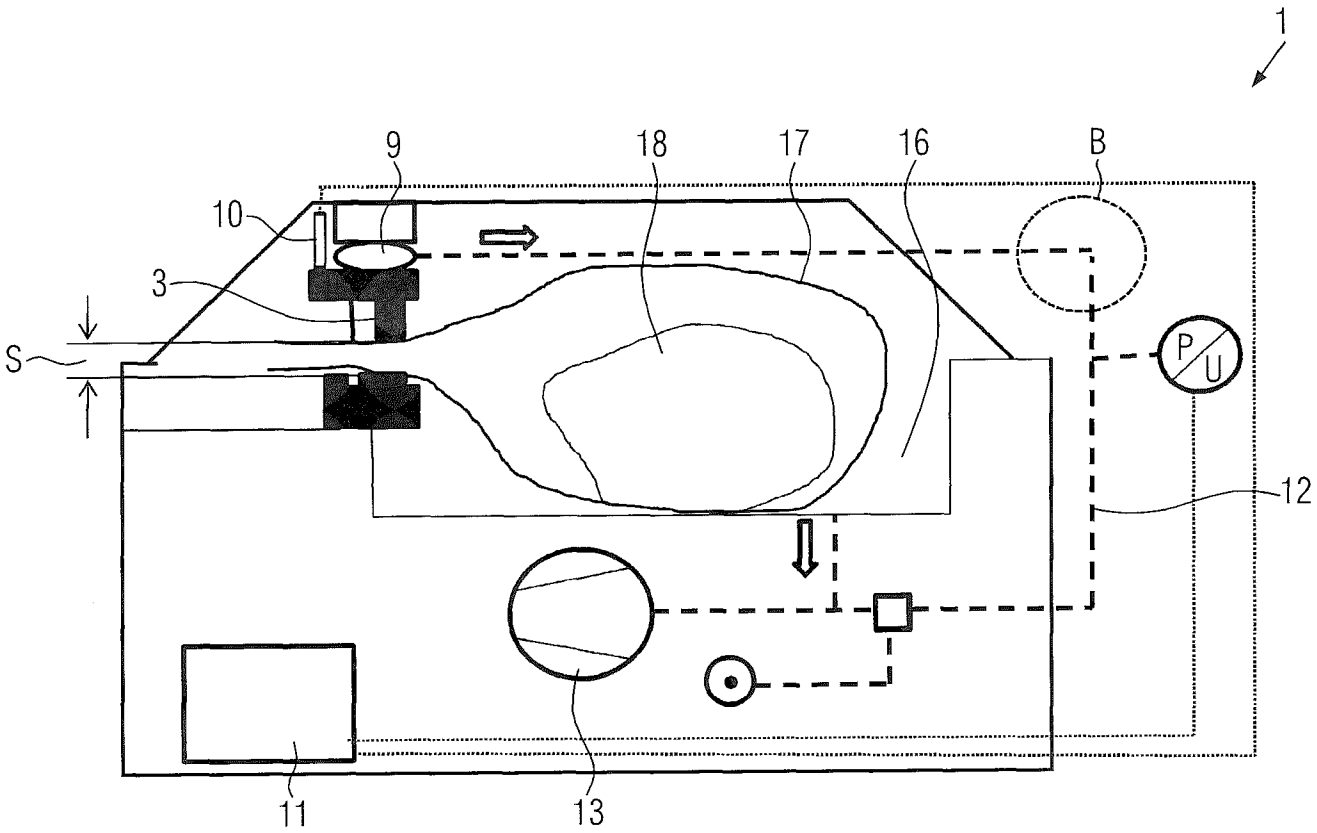
FIG. 3 is a side sectional view of the chamber machine of FIG. 1 during evacuation.

FIG. 3 shows the chamber machine 1 in the evacuation mode. In this mode, the vacuum chamber 16, in which the bag 17 with a product 18 is located, is evacuated by the vacuum pump 13 to reduce the oxygen content as much as possible in the bag 17, preferably if the product 18 is a food product. It is important that the gap S between the sealing bar 3 and the counter-pressure bar 5 has a defined minimum width, because otherwise the result can deteriorate despite the final vacuum being set and reached. For example, a leak in section B of the supply line 12 of the diaphragm 9 would cause the vacuum generated in the vacuum chamber 16 to draw the ambient pressure into the diaphragm 9, and the diaphragm 9 to thereby expand, and the sealing rail 3 to move downwardly and the gap S to be uncontrollably reduced. This error can be recognized by the control unit 11 via the sensor 10, as soon as the sealing bar 3 moves from the evacuation position downwardly. The control unit 11 can display via the display 6 a respective error message to an operator.

Figure 4:
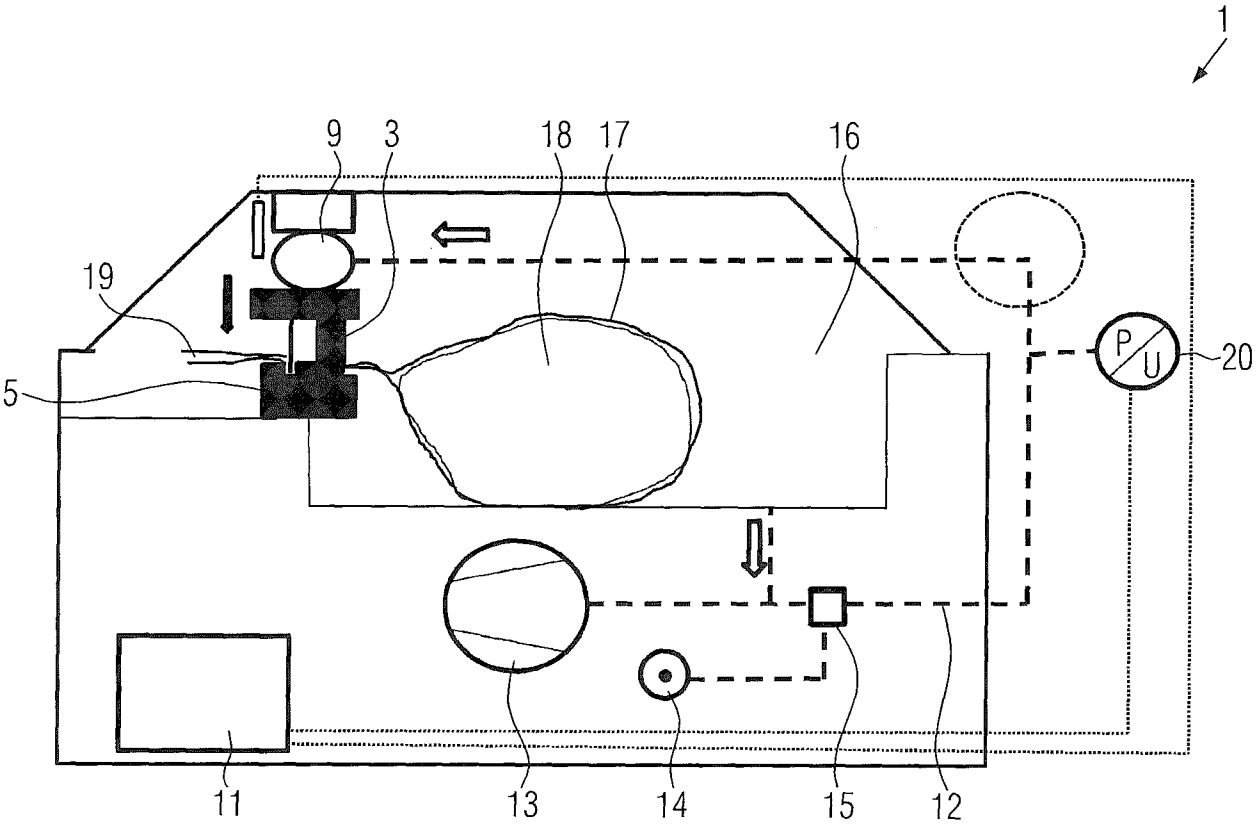
FIG. 4 is a side sectional view of the chamber machine of FIG. 1 during sealing.

FIG. 4 shows the chamber machine 1 when sealing the bag 17 after the adjusted final vacuum in the vacuum chamber 16 has been reached. For this purpose, the control unit 11 can switch the supply line 12 of the diaphragm 9 from the vacuum pump 13 to the compressed air source 14 using the valve 15, so that the compressed air fills the diaphragm 9 and presses the sealing bar 3 downwardly against the counter-pressure bar 5. The bag neck 19 clamped between the sealing bar 3 and the counter-pressure bar 5 is sealed in that the sealing bar 3 itself is heated or in that a heating wire is provided on the underside of the sealing bar 3. During the downwardly motion of the sealing bar 3, the blade bar 7 may separate the bag neck 19 from the bag 17. In order to be able to maintain the quality of the seal, the pressure at which the diaphragm 9 is acted upon can be monitored by the control unit 11 using a pressure measuring unit 20 arranged at the supply line 12. During this check, any defect or any leakage in either the diaphragm 9, or the supply line 12, or the compressed air source 14 may be detected.

When the sealing operation has been terminated after a predetermined time, the control unit 11 can switch back the valve 15, so that the supply line 12 is again connected to the vacuum pump 13 and the sealing bar 3 moves upwardly away from the counter-pressure bar 5 as to release the bag 17. The vacuum chamber 16 is then vented and the cover 2 can be opened to remove the bag 17 with the product 18.

This type of chamber machine 1 may also include a conveyor belt machine that conveys the bag 17 on a conveyor belt into the vacuum chamber 16 and out of the vacuum chamber 16, where the cover 2 opens and closes automatically.

It is conceivable to have the diaphragm 9 communicating with the ambient pressure during the sealing operation instead of to the compressed source if, for example, at a final vacuum of 20 mbar, a sealing pressure of approx. 1 bar is sufficient in order to close a bag 17 in an airtight manner.

An embodiment is possible in which the counter-pressure bar 5 is provided at the cover 2 and the sealing bar 3 with the diaphragm 9 in the vacuum chamber 16, or another sealing bar is provided in place of the counter-pressure bar 5.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Method for operating a chamber packaging machine or a conveyor belt packaging machine comprising a control unit, a sealing bar, a cover, a counter-pressure bar, a diaphragm and a sensor, said method comprising the steps of:

forming a vacuum chamber by closing said cover;

evacuating said vacuum chamber;

evacuating said diaphragm and checking with said sensor whether said sealing bar is in its predetermined evacuation position;

applying compressed air to said diaphragm after evacuation in order to generate sealing pressure between said sealing bar and said counter-pressure bar to seal a product in a bag in an airtight manner; and transmitting information from the control unit to the operator via a display when one of the position of said sealing bar during evacuation of said diaphragm is not in its predetermined evacuation position, or said sealing pressure during said sealing operation is below a predetermined sealing pressure.

2. Method according to claim 1, further comprising checking said sealing pressure in a supply line disposed between said diaphragm and a compressed air source using a pressure measuring unit.

3. The method according to claim 1 wherein said diaphragm is in fluid communication with a vacuum pump, and said evacuating said diaphragm step further comprises evacuating said diaphragm with said vacuum pump.

4. The method according to claim 3 wherein said diaphragm is in fluid communication with a compressed air source and said applying compressed air to said diaphragm step includes applying compressed air from said compressed air source.

5. The method according to claim 4 further comprising the step switching the fluid communication of said diaphragm from said vacuum pump to said compressed air source using a three-way valve, wherein said three-way valve is in fluid communication with said diaphragm, said vacuum pump and said compressed air source.

* * * * *